US006585137B1

(12) United States Patent
Archuleta

(10) Patent No.: US 6,585,137 B1
(45) Date of Patent: Jul. 1, 2003

(54) CARRYING CASE FOR SKATEBOARD WITH SEE-THROUGH PROTECTIVE COVERING FOR WHEEL ASSEMBLIES

(76) Inventor: Gary E. Archuleta, 13710 Silverlake Dr., Poway, CA (US) 92064

( * ) Notice: Subject to any disclaimer, the term of this patent is extended or adjusted under 35 U.S.C. 154(b) by 0 days.

(21) Appl. No.: 10/309,043

(22) Filed: Dec. 4, 2002

(51) Int. Cl.[7] ..... A45F 3/02

(52) U.S. Cl. ..... 224/617; 224/657; 224/576; D3/261

(58) Field of Search ..... 224/607, 613, 224/617, 657, 249, 652, 576, 913; D3/261, 317

(56) References Cited

U.S. PATENT DOCUMENTS 3,339,607 A * 9/1967 Howard ..... 224/917.5
D258,703 S * 3/1981 Ogle et al. ..... D3/261
4,334,601 A * 6/1982 Davis ..... 224/617
4,790,460 A 12/1988 Harper, Jr.
5,092,506 A 3/1992 Bolduc
5,344,056 A 9/1994 Challoner et al.
5,492,254 A 2/1996 Challoner et al.
6,009,996 A * 1/2000 Purdy ..... 224/913
6,050,357 A 4/2000 Staelin et al.
6,155,206 A * 12/2000 Godshaw ..... 119/453
6,371,346 B1 4/2002 Sharma

* cited by examiner

*Primary Examiner*—Nathan J. Newhouse
(74) *Attorney, Agent, or Firm*—Donald J. Lecher, P.C.

(57) ABSTRACT

This technical disclosure is for a carrying case for a skateboard having an elongate body including forward and rearward wheel assemblies longitudinally aligned medially on a bottom portion of the skateboard body. The carrying case includes an enclosure that provides an inner storage area for enclosing the skateboard body and an opening on the enclosure for storing and retrieving the skateboard into and out of the storage area. A zipper closure located around a peripheral edge of the opening allows for secure closing and opening of the carrying case. The carrying case has two apertures for receiving the forward and rearward wheel assemblies of the skateboard therethrough when the skateboard is placed in the inner storage area of the carrying case. A covering member covers each apertures and covers the forward and rearward wheel assemblies that project through the apertures when the skateboard is located in the inner storage area of the carrying case.

16 Claims, 3 Drawing Sheets

CARRYING CASE FOR SKATEBOARD WITH SEE-THROUGH PROTECTIVE COVERING FOR WHEEL ASSEMBLIES

FIELD OF INVENTION

This invention relates to a carrying case for skateboards that enclose the body portion of the skateboard but allow for the skateboard wheel assemblies, or trucks, to project through apertures in the carrying case. More particularly, the invention is directed to a see-through wheel assembly covering material that covers these apertures when not storing a skateboard and that covers over the received wheel assemblies when projecting through the apertures.

DESCRIPTION OF PRIOR ART

Skateboard carriers and organizations of various types for transport and portage of equipment is known in the prior art. Heretofore, however, a carrying case that provides for the visual inspection and immobilization of the skateboard wheel assemblies, or trucks, when the skateboard is placed in the case has heretofore not been provided, as set forth by the instant invention.

Examples may be found in Sharma, U.S. Pat. No. 6,371,346, that sets forth an interchangeable carrying sling that may be used to hold a skateboard by loops at distal ends of the carrying sling that fit around each of the truck assemblies.

Harper, Jr., U.S. Pat. No. 4,790,460, sets forth a skateboard carrier that enables a person to carry the skateboard on a padded board the placed on the carrier's back. The skateboard is retained on the padded board with elastic straps that span across the skateboard leaving the wheel assemblies uncovered and exposed.

Staelin et al., U.S. Pat. No. 6,050,357, sets forth a powered skateboard that has a self-contained carrying bag that completely covers the entire skateboard and truck assemblies.

Challoner et al., U.S. Pat. Nos. 5,344,056 & 5,492,254, sets forth a skateboard carrier that has retaining members that cover the front and rear portion of the skateboard up to the wheel assemblies. A plurality of straps span across the mid-section of the skateboard between the front and rear wheel assemblies. However, the wheel assemblies are uncovered and exposed.

Bolduc, U.S. Pat. No. 5,092,506, sets forth a skateboard carrier that has an enclosure that completely covers the skateboard body with apertures that allow the wheel assemblies to project therethrough uncovered. The design is similar to the above mentioned prior art in that the case has means to secure the enclosure to retain the skateboard during transport and straps or handles to carry the case over the body.

BACKGROUND OF THE INVENTION

This invention addresses the requirement for a low cost, portable skateboard carrier as set forth by the instant invention which addresses the issues of ease of use, comfort of the carrier during transportation and a see-through covering of the skateboard wheel assemblies when the skateboard is stowed in the carrying case. Due to many municipal and school regulations regarding the use and transportation of skateboards and the heightened state of security and screening of carrying cases at schools, airports and by local officials, there exists a need for a skateboard carrying case that meets these new regulations and security procedures.

Skateboard carrying cases that completely cover the skateboard and thereby prohibit visual inspection of the contents therein are problematic when security or school officials need to determine the contents of the carrying case. The carrier must then open the carrying case for visual inspection at the risk of having the contents of the case fall out.

Skateboard carrying cases that cover the skateboard with the exception of the wheel assemblies, or trucks, have been prohibited from many areas since the stored skateboard can roll away on the exposed trucks out of the control of the carrier if set down or dropped. This "run-away" condition has prompted regulation that prohibits this type of skateboard carrying case on school buses, crowded school passageways, staircases, and the like.

The skateboard carrying case of the present invention addresses these above issues by providing apertures in the enclosure of the carrying case itself to allow the wheel assemblies to project therethrough when the skateboard is stored in the carrying case. However, when the wheel assemblies project through the apertures, they are restrained by a see-through material that expands out from the apertures to prevent the wheels from rotating and at the same time providing for easy visual inspection and identification of the primary contents of the carrying case, namely, the stowed skateboard.

The advantages to this invention, and more specifically the see-through wheel assembly covering material that covers the carrying case wheel assembly apertures, is that the see-through material prevents the wheels from rotating, thereby preventing the uncontrolled rolling of the stored skateboard, permits easy inspection and identification of the contents of the carrying case, keeps dirt located on the wheel assemblies from being transferred to objects that it comes into contact with, and allows for wheels on the wheel assemblies to be contained if they inadvertently would have fallen. Additionally, the see-through wheel assembly covering material can allow for graphic printing thereon that does not prohibit its see-through property, thus enhancing the total printable area of the carrying case for graphic design and printing thereon.

The see-through wheel assembly covering material has the structural characteristic allowing its expansion to receive the stored wheel assemblies when the skateboard is stored in the carrying case. This may be achieved by the see-through material having elastic properties or attached to the periphery of the enclosure apertures in a pleated manner, or both. This volume expanding characteristic allows for different sized or configured wheel assemblies to be stored in the same dimensioned carrying case thereby eliminating the need for different sized cases for differed sized skateboard and wheel assemblies, and allows the see-through material to retract back across the enclosure apertures when not in use.

SUMMARY OF INVENTION

The carrying case for a skateboard having a skateboard body that includes forward and rearward wheel assemblies longitudinally aligned on the centerline of a bottom portion of the skateboard body comprises an enclosure that defines an inner storage area for enclosing the skateboard body. The enclosure has a zipper-closure opening for storing and retrieving the skateboard into and out of the inner storage area and two apertures located on the enclosure for receiving the forward and rearward wheel assemblies of the skateboard therethrough when the skateboard is placed in the inner storage area. Each of the two apertures have a covering material that cover each of the forward and rearward wheel assemblies that project through the apertures when the skateboard is located in the inner storage area of the enclosure.

The covering material that covers each aperture is made from an abrasion-resistant see-through material that covers over the apertures when no skateboard is stored in the carrying case but expands outward to receive the wheel assemblies as they project through the apertures in the enclosure. The covering material may include a breathable mesh material that allows air through but is densely woven enough to retain the wheel assemblies and any other object in the carrying case from passing therethrough. The covering material may include an elastic material that provides a flush fitting over apertures in the enclosure when no skateboard is stored in the carrying case but expand outward to receive the wheel assemblies as they project through the apertures. Additionally, the covering material may provide for a pleated configuration that gathers overlapping sections of the covering material together at the attachment portion of the peripheral edge of the apertures to provide a flush fitting over apertures in the enclosure when no skateboard is stored in the carrying case but expand outward to receive the wheel assemblies as they project through the apertures.

The carrying case is constructed of an outer shell material made of abrasion resistant material for durability during transportation and an inner liner material made of a non-abrasive material to prevent any surface damage to contents stored inside the carrying case.

The carrying case is constructed having a front section that receives the wheel assemblies of a stored skateboard and a padded back section that provides comfort during transportation by a user when carried via a back section attached sling.

The two front and back sections of the carrying case have bottom portions that are fixedly attached together to provide a bottom pocket area to retain a skateboard when the zipper closure is in either a closed or open position. The zipper closure then extends from the bottom pocket area along the periphery of a common edge of the front and back sections to over and around a top portion of the carrying case to allow easy access to the inner storage area of the carrying case when the zipper closure is in an open position. At the furthest point of zipper travel in the closed position is a zipper locking tab fixedly attached to the outer surface of the carrying case. A small padlock type device can then be inserted through the zipper locking tab and the zipper pull tab to lock the zipper in a closed position and thereby prevent unauthorized access to contents stored within the carrying case.

A storage pocket is located on the front section of the carrying case between the apertures to receive the skateboard wheel assemblies. The pocket in the preferred embodiment has a hook and loop closure flap to facilitate securing and access to the contents of the pocket. The pocket additionally has a split window on the outer pocket panel that allows the window to open to the exterior when contents are placed within the storage pocket. A see-through liner material having similar properties to the see-through covering material mentioned above in this section cover the interior portion of the outer pocket panel that retain the contents within the storage pocket but allow for easy visual inspection and identification of contents within the pocket.

The carrying case is transported by means of a pair of handles located on the outer mid-section of the case. The pair of handles comprises a single handle on each of the front and back sections of the carrying case that allows the case to be carried by a user grasping both handles. The handles are attached to the outer surface of both the front and back sections of the carrying case and extend to the opposite side of the carrying case to increase the durability and strength of the attachment.

An additional aid in transporting the case consists of a sling mounted on the back section of the case to assist in carrying the case without using hands, for an example, over a person's shoulder. A sling with swivel clips is releaseably attached to top and bottom mounted retention rings fixably attached to retention tabs on an exterior surface of the back section of the carrying case. The retention tabs can be mounted in parallel with the longitudinal direction of the carrying case or may be mounted at an angle to the longitudinal direction of the carrying case to keep the top portion of the carrying case from contacting the back side of the head depending on how a user is transporting the carrying case on their back.

The lightweight, durability of construction, ease of transport featuring see-through restraint of a stowed skateboard's wheel assemblies of the present invention will become more readily apparent from a consideration of the following drawings and description.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION OF THE INVENTION

Figure 1:
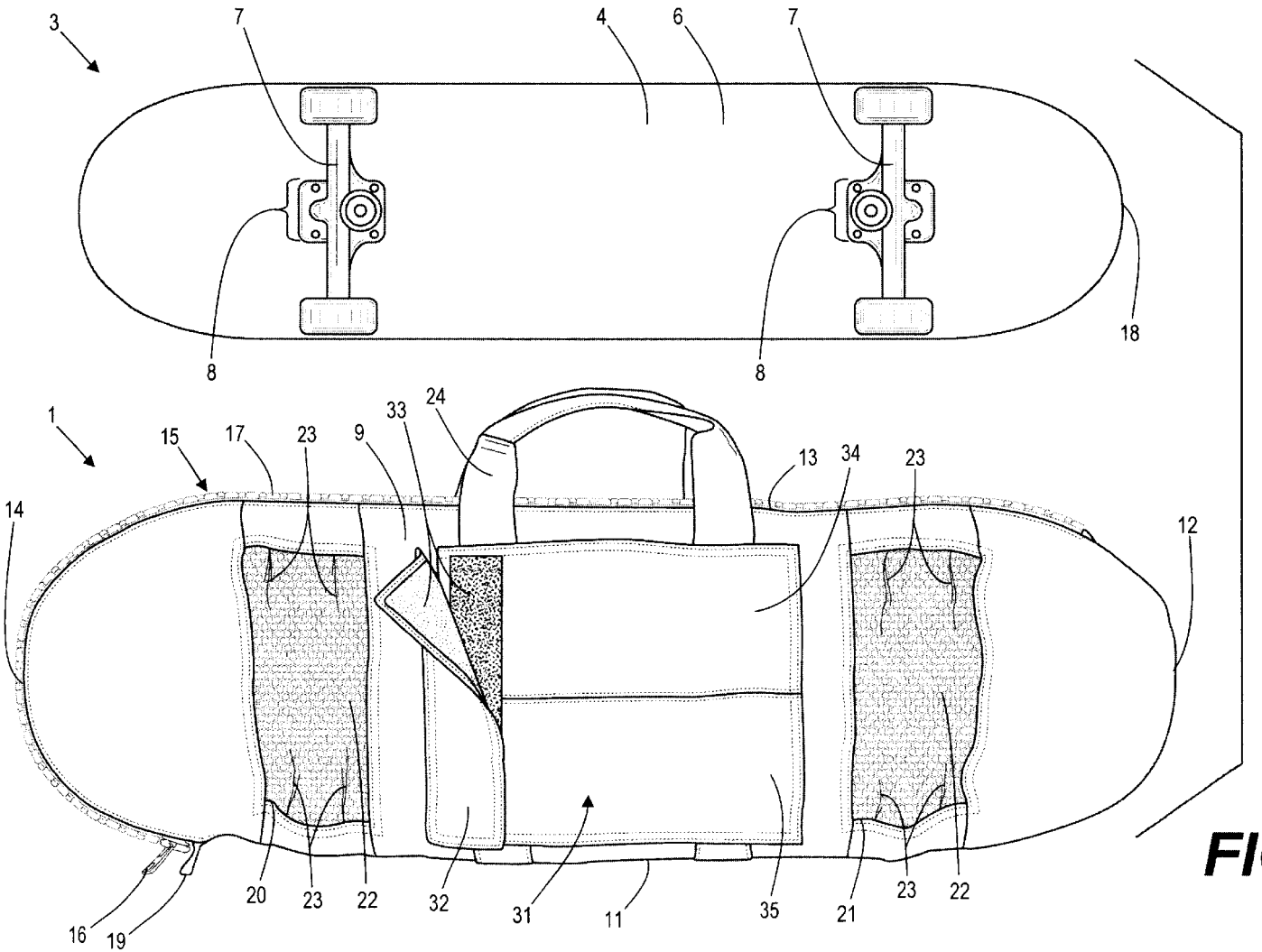
FIG. 1 is a front elevational view of the skateboard carrier and a bottom view of a skateboard designed to fit within the skateboard carrier.
Figure 2:
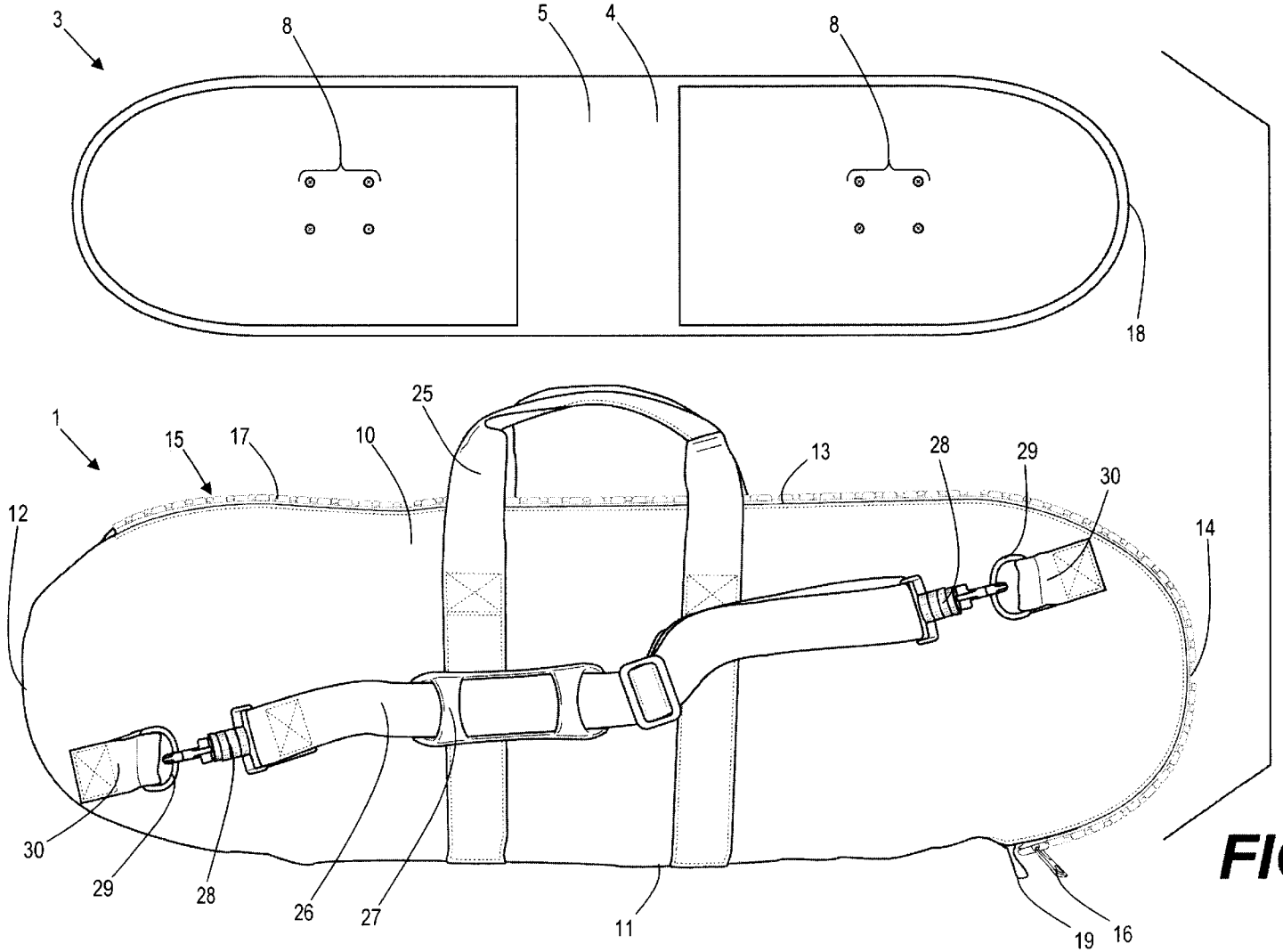
FIG. 2 is a rear elevational view of the skateboard carrier and a top view of a skateboard designed to fit within the skateboard carrier.
Figure 3:
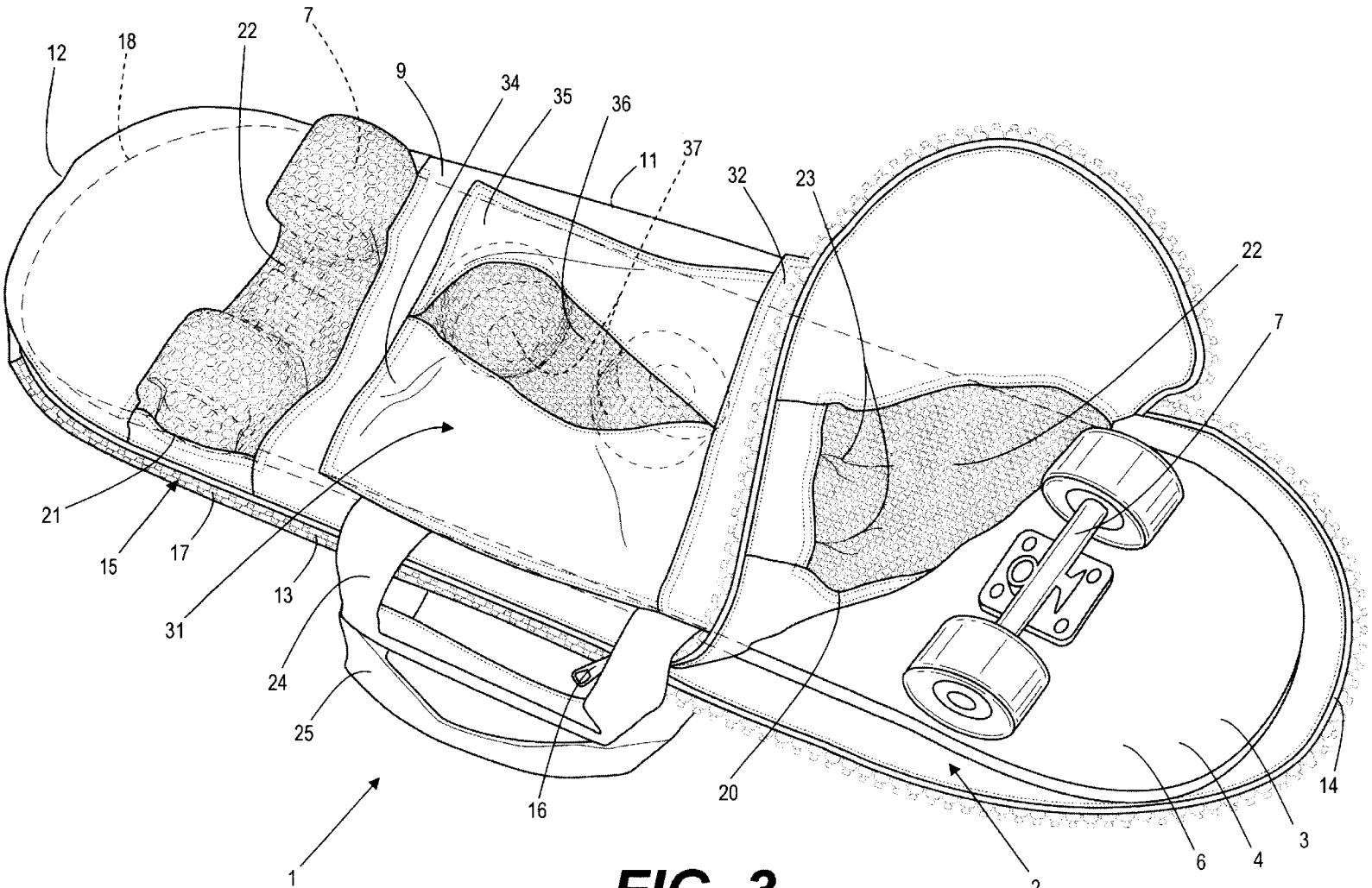
FIG. 3 is a perspective view of the skateboard carrier with a skateboard stowed in an inner storage area having one set of wheel assemblies projecting through a carrier case aperture covered by a see-through restraining material, the second set of wheel assemblies exposed, and a center pocket having stored items located therein.

FIGS. 1–2 illustrate a skateboard carrying case 1 of the instant invention designed to have an inner compartment 2, see FIG. 3, to store a skateboard 3. The skateboard 3 has an elongate skateboard body 4 having a top surface 5 that carries a rider and a bottom surface 6 having forward and rearward wheel assemblies 7, or trucks, attached thereto via attachment hardware 8 through the top surface 5.

The carrying case 1 consists of a protective enclosure having a front panel section 9 and a rear panel section 10. The exterior material of both front 9 and rear 10 panel sections is made of abrasion resistant material to protect the carrying case 1 from damage to the interior contents, whereas the interior material is made of a non-abrasive material to protect the skateboard and/or other contents from being damaged or scratched. The rear panel section 10 has interior padding to provide comfort when the carrying case 1 is on a user's back or for added protection during transport.

The front 9 and rear 10 panel sections are fixedly attached to each other along a first longitudinal side portion 11 and a bottom end portion 12. Attachment of these panel sectitons and the additional elements necessary to be attached to the carrying case 1 or to each other as disclosed below can be accomplished through stitching with heavy-duty stitching material, (see representative dotted lines in FIGS. 1–3), or with any equivalent attachment methods, for example, heat welding, ultrasonic welding, adhesives, or the equivalent thereof. The remaining longitudinal side portion 13 and top end portion 14 are each releaseably attached together with a zipper closure mechanism 15 having a zipper pull tab 16 and corresponding zipper teeth strips 17 along the outer peripheral edge of the front 9 and rear 10 panel sections.

The bottom end portion 12 is has no zipper closure mechanism 15 allowing for a secure pocket-like structure to hold a corresponding end 18 of the skateboard 3 when the carrying case 1 and skateboard 3 is in a vertical position with the zipper closure mechanism 15 in either an open or a closed position. For the same reason, the first longitudinal side portion 11 has no zipper closure mechanism for holding the skateboard 3 in a horizontal position with the zipper closure mechanism 15 in either an open or a closed position. This structural configuration allows for less force to be applied to the zipper closure mechanism 15 while the carrying case 1 is either vertically or horizontally transported and thus prolongs the durability of the case by reducing the wearing resistance on the zipper closure mechanism 15 during transport. An alternative embodiment of the zipper configuration not represented in the drawings would allow the zipper closure mechanism 15 to follow around the peripheral edge of the bottom end portion 12 to allow for easier access to the carrying case 1 if needed.

When the zipper closure mechanism 15 is in its fully closed position, as shown in FIGS. 1 & 2, the zipper pull tab 16 can be locked in its fully closed position to locking tab 19 with a small keyed padlock or combination-type locking device.

Top 20 and bottom 21 apertures are located on the front panel section 9 of the carrying case 1 for receiving the front and rear wheel assemblies 7 when the skateboard 3 is stored in the inner compartment 2 of the carrying case 1 as shown in FIG. 3. A see-through material 22 is attached along the inner peripheral edges of the top 20 and bottom 21 apertures. The see-through material is can have elastic properties to be retained across the opening of the apertures 20 & 21 when no skateboard is stored in the carrying case 1, or it may have pleating 23 designed to accomplish the same function. When the wheel assemblies 7 project through the apertures 20 & 21, as shown in one instance at the bottom end section and left side of FIG. 3, the see-through material 22 expands away from the apertures 20 & 21 to receive and completely cover the wheel assemblies 7. Thus, the see-through material 22 prevents the wheel assemblies 7 from rotating, provides for easy visual inspection and identification of the contents of the carrying case 1 when a skateboard is stored inside, prevents dirt on the wheel assemblies from becoming transferred to other objects by coming into direct contact with them, retains the wheels on the wheel assemblies should they inadvertently be loosed from the wheel assemblies, and provides for different sized wheel assemblies of various skateboards to be stored in the carrying case 1 on account of the expansion and retraction of the see-through material 22.

The see-through material 22 may be made of a breathable mesh material having a mesh opening size sufficient to accomplish the above objectives of the present invention. Additionally, the presence of a see-through material having a screen or mesh-like quality provides for the ability to print graphical images across the see-through screen or mesh material and not obscure the ability to allow visual inspection through the see-through screen or mesh material. This feature is advantageous in printing graphical designs or logos across the surface of the carrying case 1 that otherwise would have to avoid the wheel assembly 7 apertures 20 & 21 due to the inability of a surface suitable for printing thereon.

The carrying case 1 has a front handle 24 attached to and across the middle of the front panel section 9, and a back handle 25 attached to and across the middle of the back panel section 10. Each front 24 & back handle 25 assist in closing the front 9 and rear 10 panel sections when the zipper closure assembly 15 is in an open position, and when in a closed position, see FIGS. 1 & 2, allow carrying the carrying case 1 in a horizontal position.

The back panel section 10 has a sling member 26 with a shoulder pad 27 and swivel snap fasteners 28 at both distal ends. The swivel snap fasteners 28 are releaseably connected to attachment rings 29 that are fixably attached to retainer tabs 30 on the outer surface of back panel section 10. FIG. 2 shows the alignment of the top and bottom retainer tabs 30 to be at an angle to the longitudinal centerline of the carrying case 1, while in another anticipated embodiment, the alignment of the retainer tabs 30 may be in parallel to the centerline of the carrying case 1. The angular alignment of the retainer tabs 30 may be configured to provide the greatest comfort to the user during transportation on the back by the sling member 26.

FIGS. 1 & 3 show pocket 31 attached to the front panel section 9 of the carrying case 1 having an opening flap 32 secured to the outer pocket by releasable hook and loop fastener strips 33. The pocket 31 is located between the apertures 20 & 21 and over the front handle 24 attachment portion to the front panel section 9. However, pockets of various sizes and configurations may be placed in other locations on the carrying case 1 as need and function permits. Pocket 31 has right 34 and left 35 outer panel pocket members attached at their outer and bottom edges to the exterior surface of front panel section 9. The inner edges of right 34 and left 35 outer panel pocket members are only connected at their top portions, near opening flap 32 and beneath the hook and loop fastener strips 33, and their bottom portions attached to front panel section 9. The inner edges of right 34 and left 35 outer panel pocket members remain unattached to each other and provide an opening into the pocket 31. A see-through pocket material 36 retains the contents 37 placed within the pocket 31, similar in structure and nature to the see-through material 22, as previously mentioned, is attached to the inner peripheral edges of the pocket 31. When items are placed within the pocket, the right 34 and left 35 outer panel pocket members open along their inner edges to accommodate the contents within the pocket 31. See-through pocket material 36 retains the contents 37 of the pocket and provides for easy inspection and identification of those contents.

The foregoing disclosure and description of the invention are illustrative and explanatory thereof, and various changes in size, shape and materials as well as in the details of the illustrated construction may be made without departing from the spirit of the invention.

What is claimed in the preferred embodiment is:

1. A carrying case for a skateboard having an elongate skateboard body including forward and rearward wheel assemblies longitudinally aligned medially on a bottom portion of said skateboard body, wherein said carrying case comprises:

a) enclosure means that defines an inner storage area for enclosing said skateboard body;

b) opening means on said enclosure means for storing and retrieving said skateboard into and out of said inner storage area;

c) closure means located around a peripheral edge of said opening means to move said opening means between a closed position and an open position;

d) first and second aperture means located on said enclosure means for receiving said forward and rearward wheel assemblies of said skateboard therethrough when said skateboard is placed in said inner storage area of said enclosure means; and e) covering means for covering said first and second aperture means and said forward and rearward wheel assemblies that project through said first and second aperture means when said skateboard is located in said inner storage area of said enclosure means.

2. The carrying case of claim 1 wherein said covering means includes a see-through material.

3. The carrying case of claim 2 wherein said covering means includes a breathable mesh material.

4. The carrying case of claim 2 wherein said covering means includes an elastic material.

5. The carrying case of claim 2 wherein said covering means includes a pleated volume expanding material.

6. The carrying case of claim 2 wherein said covering means includes printable surface means for receiving graphical printing thereon, wherein when said printable surface means receives said graphical printing said graphical printing fails to obscure the see-through property of said see-through material.

7. The carrying case of claim 1 wherein said enclosure means includes:

a) an outer shell material made of abrasion resistant material; and b) an inner liner material made of a non-abrasive material.

8. The carrying case of claim 1 wherein said enclosure means includes:

force absorbing means on a first portion of said enclosure means opposite a second portion of said enclosure means having said first and second aperture means, said force absorbing means for providing padding when said carrying case is transported on a carrier.

9. The carrying case of claim 1 wherein said enclosure means includes:

a) a first enclosure portion having two oppositely disposed longitudinal sides, a bottom portion and a top portion, said first enclosure portion sized and shaped to cover a top portion of said skateboard body;

b) a second enclosure portion having two oppositely disposed longitudinal sides, a bottom portion and a top portion, said second enclosure portion sized and shaped to cover said bottom portion of said skateboard body, wherein said second enclosure portion contains said first and second aperture means and said covering means;

c) said first enclosure portion is fixedly attached to said second enclosure portion along a reciprocal first edge of said longitudinal sides and said reciprocal bottom portions; and d) said closure means is located on said first and second enclosure portions on a reciprocal second of said longitudinal sides and said reciprocal top portions.

10. The carrying case of claim 1 wherein said enclosure means includes:

storage pocket means for storing having an exterior pocket member attached to an outside portion of said enclosure means.

11. The carrying case of claim 10 wherein said storage pocket means has:

pocket aperture means on said exterior pocket member for allowing contents within said storage pocket means to be visually inspected; and see-through liner means attached to an interior side of said exterior pocket member for providing retention and visual inspection of contents in said storage pocket means.

12. The carrying case of claim 1 wherein said closure means includes:

zipper means for closing and opening two adjoining edges of said opening means.

13. The carrying case of claim 1 includes:

handle means located on an exterior surface of said enclosure means for transporting said carrying case.

14. The carrying case of claim 1 includes:

sling carrying means located on an exterior surface of said enclosure means for transporting said carrying case.

15. The carrying case of claim 14 wherein said sling carrying means includes:

a) top and bottom retention means attached to said exterior surface of said enclosure means, said top and bottom retention means each having affixed attachment means thereon; and b) adjustable strap means releaseably attached to said retention means for transporting said carrying case.

16. The carrying case of claim 15 wherein said top and bottom retention means are aligned at an angle to a longitudinal center line of said enclosure means.

* * * * *